US005546108A

United States Patent [19]

Hotomi et al.

[11] Patent Number: 5,546,108

[45] Date of Patent: Aug. 13, 1996

[54] INK-JET TYPE RECORDER HAVING AN INK CARRIER AND LETTING INK BY COMBINED HEAT AND ELETROSTATIC FORCE

[75] Inventors: Hideo Hotomi, Ibaragi; Osamu Ebisu, Toyonaka; Kazuo Ota, Nishinomiya, all of Japan

[73] Assignee: Minolta Camera Kabushiki Kaisha, Osaka, Japan

[21] Appl. No.: 402,153

[22] Filed: Mar. 9, 1995

Related U.S. Application Data

[63] Continuation of Ser. No. 975,073, Nov. 12, 1992, abandoned.

[30] Foreign Application Priority Data

Nov. 13, 1991 [JP] Japan ..... 3-296797

[51] Int. Cl.[6] ..... B41J 2/06; B41J 2/05; B41J 2/175

[52] U.S. Cl. ..... 347/55; 347/66; 347/91

[58] Field of Search ..... 347/55, 66, 91, 347/48

[56] References Cited

U.S. PATENT DOCUMENTS

| | | | |
|---|---|---|---|
| 4,801,951 | 1/1989 | Shimazaki | 346/140 R |
| 5,021,808 | 6/1991 | Kohyama | 347/66 |
| 5,124,729 | 6/1992 | Nakazawa et al. | 347/55 |

FOREIGN PATENT DOCUMENTS

| | | | |
|---|---|---|---|
| 55-65590 | 5/1980 | Japan | B41J 3/20 |
| 62-64554 | 3/1987 | Japan | B41J 3/04 |
| 66278046 | 12/1987 | Japan . | |
| 02059350 | 2/1990 | Japan | B41J 2/05 |
| 02059351 | 2/1990 | Japan | B41J 2/05 |

*Primary Examiner*—Benjamin R. Fuller
*Assistant Examiner*—David Yockey
*Attorney, Agent, or Firm*—Brinks Hofer Gilson & Lione

[57] ABSTRACT

The present invention discloses an ink-jet type recorder that forms an ink image on a recording medium comprising a porous ink carrier withholding ink in the pores, an ink tank at a soaking position a transferring device for transferring ink carrier from the soaking position to a recording position where the ink carrier and the recording medium face each other, a heating device for heating the ink withheld in pores of the ink carrier to a certain temperature, the heating device including a contact heater which is in contact with the ink carrier at the recording position so as to conduct heat from the contact heater to the withheld ink, and the certain temperature being sufficiently high to lower the viscosity of the ink but insufficiently high to boil the ink, and an electric field generating device for generating an electric field in order to activate an electrostatic force in such a way that the ink is attracted onto the recording medium from the ink carrier. In one embodiment, the electric field generating device includes an electrode in contact with the porous member between the soaking position and the recording position. In a further embodiment, the ink carrier is fixedly provided and extends from the soaking position to the recording position.

9 Claims, 10 Drawing Sheets

Fig. 3

Nylon Mesh (Nytal:TANAKA SANJIRO CO.,LTD)

| Model No. | HD-10 | | HD-20 | | AST400-37 | | DIN-40 | |
|---|---|---|---|---|---|---|---|---|
| Thread Diameter (μm) | Warp | Woof | Warp | Woof | Warp | Woof | Warp | Woof |
| | 42 | | 34 | | 30 | | 90 | |
| Aperture μm around | 10 | | 20 | | 37 | | 40 | |
| Model No. | ASTM-53 | | 20TI-56 | | 21Nxx-71 | | 15Nxx-85 | |
| Thread diameter (μm) | Warp | Woof | Warp | Woof | Warp | Woof | Warp | Woof |
| | 35 | | 43 | | 50 | 43 | 50 | |
| Aperture μm around | 53 | | 56 | | 71 | | 85 | |
| Model No. | 14Nxx-95 | | 12½N-106 | | | | | |
| Thread diameter (μm) | Warp | Woof | Warp | Woof | Warp | Woof | Warp | Woof |
| | 70 | | 60 | 50 | | | | |
| Aperture μm around | 95 | | 106 | | | | | |

Fig. 4

Meshes Other Than Nylon Mesh
( 1 : TANAKA SANJIRO CO., LTD.)
( 2 : MESH KOGYO K.K.)

| Model No. | COP-70*1 | PP-74*1 | PA/CF-63/32*1 |
|---|---|---|---|
| Trade Name | Fluortex | Propyltex | Nytal |
| Material | Teflon | Polypropylene | Rayon plus Carbon Dispersion |
| Thread Diameter (μm) | 80 | 74 | 20 |
| Aperture μm around | 70 | 85 | 63 |
| Model No. | 195T*1 | AISI*2 | |
| Trade Name | Estal mono | 500 Mesh | |
| Material | Polyester | Stainless (SUS) | |
| Thread Diameter (μm) | 18 | 18 | |
| Aperture μm around | 32 | 32 | |

Fig. 5

Physical Properties of the Ink and Ink Carrier

| | Particulars | Specific Heat (at 25°C) [cal/g·°C] | Heat Conductivity (at 25°C) [$10^{-4}$ cal/sec·cm·°C | Remarks |
|---|---|---|---|---|
| Ink Carrier | HD-10 | ~0.4 | ~5.2 | Nylon |
| | HD-20 | 0.4 | 5.2 | Nylon |
| | ASTM400-37 | 0.45 | 5.8 | Nylon |
| | DIN-40 | 0.35 | 5.0 | Nylon |
| | ASTM-53 | 0.45 | 5.8 | Nylon |
| | 20TI-56 | 0.42 | 5.4 | Nylon |
| | 21Nxx-71 | 0.40 | 5.6 | Nylon |
| | 15Nxx-85 | 0.42 | 5.6 | Nylon |
| | 14Nxx-95 | 0.42 | 5.6 | Nylon |
| | 12½N-106 | 0.45 | 5.8 | Nylon |
| | COP-70 | 0.22 | 6.0 | Teflon |
| | PP-74 | 0.5 | 2.2 | Polypropylene |
| | PA/CF-63/32 | 0.36 | 5.1 | Rayon plus Carbon Dispersion |
| | Estal mono | 0.37 | 4.0 | Polyester |
| | Stainless(SUS) | 0.12 | 358.3 | Stainless (Preferably coated with an insulator) |
| | Polyimide Film | 0.27 | 2.5 | Done with Excimer Laser Treatment |

Fig. 9

| | Particulars | Specific Heat (at 25°C) [cal/g °C] | Heat Conductivity (at25°C) [$10^{-4}$ cal/sec·cm·°C] |
|---|---|---|---|
| Ink | Preferable Range | 0.1~0.9 | 1.5~100 |
| | More preferable Range | 0.2~0.7 | 2.0~70 |
| | Reason *1 | The one smaller than 0.1 causes a cross talk. | The one smaller than 1.5 makes the printing head inoperative due to massive power required. |
| | | The one larger than 0.9 makes the printing head inoperative due to massive power required. | The one larger than 100 causes a cross talk. |

*1 Experiments on Initial Printing (1 line)

INK-JET TYPE RECORDER HAVING AN INK CARRIER AND LETTING INK BY COMBINED HEAT AND ELETROSTATIC FORCE

This application is a continuation of application Ser. No. 07/975,073, filed Nov. 12, 1992, now abandoned.

BACKGROUND OF THE INVENTION (1) Field of the Invention

The present invention relates to an ink-jet type recorder that records characters and images onto a recording medium by means of adhesion of ink withheld in an ink carrier.

(2) Description of the Related Art

A conventional recording method is disclosed in Japanese Laid-open Patent Application No. 55-65590, by which solid ink withheld by the ink carrier is melted with thermal energy while being transferred onto the recording medium with electrical energy.

Another conventional recording method, a so-called bubble-jet method, is disclosed in Japanese Laid-open Patent Application No. 62-64554, by which liquid ink of water dyes withheld by the ink carrier is boiled with thermal energy, thence being spouted out onto the recording medium under the resulting pressure.

However, in the former method, the recorder requires a large amount of running electricity in order to generate thermal energy. In addition, it takes relatively long to melt the solid ink completely, therefore eliminating any possibility for improving a recording speed.

In the latter case as well, the liquid ink easily discolors or burns because of heating at a considerably high temperature. Moreover, a thermal head is damaged due to oxidation or a shock wave caused by the boiling.

SUMMARY OF THE INVENTION

The present invention therefore has an object to provide an ink-jet type recorder that can prevent deterioration such as ink discoloration and damages on the thermal head while increasing the recording Speed with less running electricity.

The above object is fulfilled by an ink-jet type recorder comprising a porous ink carrier withholding liquid ink, a heating device for heating the ink to a certain temperature by means of contact, and an electric field producing device for activating a electrostatic force in such a way that the ink spouts out onto a recording medium, wherein at least one of the heating and activation of the electrostatic force is selectively carried out per pixel, and the certain temperature refers to one that is sufficiently high to lower the viscosity of the ink, but insufficiently low to boil the ink. The ink carrier may be made of nylon, fluorocarbon polymers, polypropylene, polyester, mesh metal, filter films, porous ceramics films, and porous polymer films.

With the above jet-type ink recorder, the ink spouts out onto the recording medium and forms an image when the viscosity of the ink is lowered by means of heating, while at the same time a force toward the recording medium is rendered to the ink by means of activation of the electrostatic force.

Thanks to the above construction and operation, the liquid ink ensures not only an increase of the recording speed but also heating at a relatively low temperature, requiring only a small amount of thermal energy, hence less running electricity, making it possible to prevent ink discoloration and burns as well as damages on the thermal head by the shock wave caused by ink boiling. In addition, such heating further broadens a scope of applicable pigments to high viscous pigments such as oil series pigments which are, in particular, superior in preventing the discoloration.

BRIEF DESCRIPTION OF THE DRAWINGS

These and other objects, advantages and features of the invention will become apparent from the following description thereof taken in conjunction with the accompanying drawings which illustrates specific embodiments of the invention. In the drawings:

FIG. 3 is a list of nylon meshes;

FIG. 4 is another list of nylon meshes;

FIG. 5 is a list of physical properties of the ink carrier;

FIG. 9 is a list of physical properties of the ink;

DESCRIPTION OF THE PREFERRED EMBODIMENTS

FIRST EMBODIMENT

Figure 1:
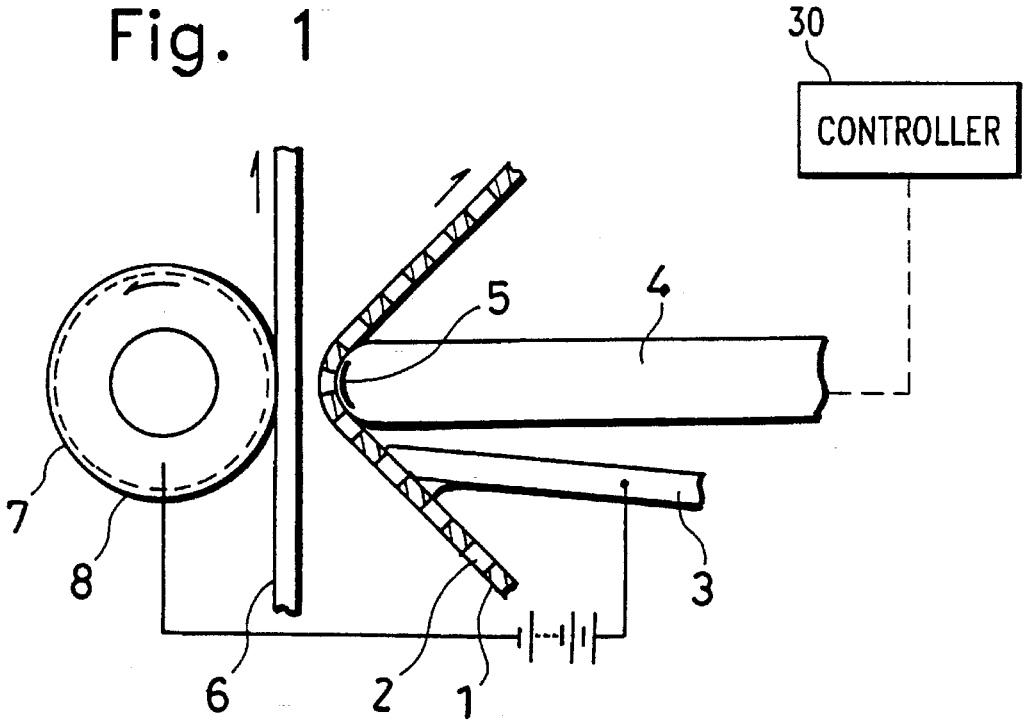
FIG. 1 is a schematic view of the major construction of the recorder in accordance with the first embodiment.

A jet-type recorder in accordance with the first embodiment of the present invention is explained hereunder with referring to the drawings.

Figure 2:
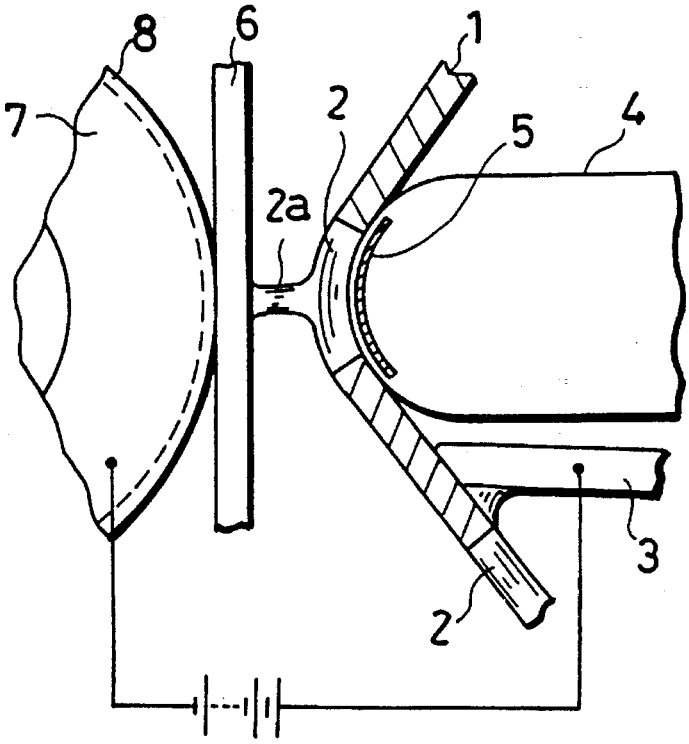
FIG. 2 is an enlarged view of FIG. 1.

FIGS. 1 and 2 are schematic views of the major construction of the recorder, in which essential components are a porous ink carrier 1 withholding liquid ink 2, a charge injecting electrode 3, a thermal head 4 coated with an unillustrated protecting layer of insulator, exothermic pixels 5, a recording sheet 6 as a recording medium, a bias platen roller 7 coated with an insulator 8.

The ink carrier 1 maintains high impedance, and the ink 2 is oil series pigment dispersion ink. The thermal head 4 is embedded with an array of the exothermic pixels 5 parallel to the axis of the bias platen roller, thus called a side-type. In the array, as many exothermic pixels 5 as the number of dots are aligned at regular intervals, which are turned 0N and OFF by a driving circuit or controller schematically illustrated at 30 in FIG. 1 based on image data. The recording sheet 6 is an A-4 size sheet in Japanese Industrial Standards. An opposite sign voltage to the charge is applied to the bias platen roller 7.

Constructed as above, the ink-jet type recorder operates as follows.

As is shown in FIG. 1, the ink carrier 1 carries the ink 2 to where it faces to the recording sheet 6 which is forwarded at a speed of 0.2–10 cm/sec by the bias platen roller 7 that rotates synchronously with the control of the exothermic pixels 5. The minimum space between the ink carrier 1 and the recording sheet 6 is set to be 400 μm. Given that only a direct current voltage of 1.5 kV is applied to the charge injecting electrode 3 and bias platen roller 7 in order to generate electrical energy, a resistive force in the form of surface tension and viscosity of the ink 2, and an attracting force, or namely the electrical energy, that tries to attract the ink 2 toward the bias platen roller 7 balance out, thus, preventing the ink 2 from spouting out from the ink carrier 1. However, when the exothermic pixels 5 are turned on, the temperature of the ink 2 rises to 50°–170° C., and its surface tension as well as viscosity decrease to 15–40 dyne/cm and 1–60 cp from 25–55 dyne/cm and 4–200 cp at a room temperature respectively, thereby upsetting the balance. Accordingly, as can be seen in FIG. 2, the ink 2 is attracted to the bias platen roller 7 in a strip, forming an ink pillar 2*a* between the ink carrier 1 and the recording sheet 6, and as much ink 2 as the volume of the ink pillar 2*a* is transferred onto the recording sheet 6, culminating in forming a dot of the image when dried and fixed thereon. In contrast, when the exothermic pixels 5 are turned off under these conditions, the surface tension as well as viscosity increase as the temperature of the ink 2 drops, and the spout of the ink 2 is halted when the balance is recovered. Hence, the recorder employing this method enables the recording of multi-tone image by controlling the temperature.

For further explanation, detailed description of the essential components hereof are provided in the following.

Ink Carrier

The ink carrier 1 is made of a mesh knitted or woven with nylon fibers, fluorocarbon polymer fibers, or carbon-containing rayon stainless threads, so that apertures therein are filled with the ink 2, the amount of which is controlled by modifying the cross sections, material, knitting methods of these fibers. The most preferable thread diameter and apertures in terms of image quality and recording density are 20–150 μm and 5–200 μm, respectively.

Commercially available meshes are listed in FIGS. 3 and 4, and thermal properties as to specific heat and heat conductivity for materials suitable to the ink carrier 1 are listed in FIG. 5.

During the researches by the inventors, it was acknowledged that the ink carrier 1 conducted thermal energy even where it was unnecessary, and invited an unfavorable ink spouts, which is known as a cross talk. It does so when it maintains smaller specific heat and/or larger heat conductivity. Likewise, the thermal head becomes inoperative due to heat accumulated therein. It does so when it maintains larger specific heat and/or smaller heat conductivity, because these conditions makes it difficult to release the heat from the thermal head, which should be taken into considerations in order to realize the multi-tone recording.

Grounding on this, the preferable specific heat is 0.1–1.0 cal/g°C. and heat conductivity is 1–400 cal/sec.cm.°C.; more preferably, 0.15–0.6 cal/g°.C. and smaller than 100 cal/sec.cm°.C.

These thermal properties are of no importance in the bubble-jet type recorder, because the cross talk will not occur until thermal energy and heat of evaporation becomes equal in amount even when nozzles erroneously conduct thermal energy. In addition, the bubble-jet type recorder uses a so-called ON/OFF image forming method for the multi-tone recording, wherein tones are adjusted by varying the number of the ink spouts.

The ink carrier 1 may be made of synthesized resin films such as porous polyimide films and porous polyamide films done with a well known excimer laser treatment or etching. The synthesized resin films are the primary choice in terms of image quality and recording density, and their preferable pore diameter is 10–200 μm around. As to thickness thereof, 10–500 μm is preferable for the porous polyimide films, whereas 15–150 μm is preferable for the porous polyamide films such that is represented by KAPTON film (Toray Industries, Inc).

As well, it may be porous ceramics films, porous filter films, and thin stainless plates made of metal including alloy and done with a pattern etching. When porous filter films or porous ceramics films are used, a preferable pore diameter and thickness are 200 Å–50 μm and 5–200 μm respectively.

Figure 6:
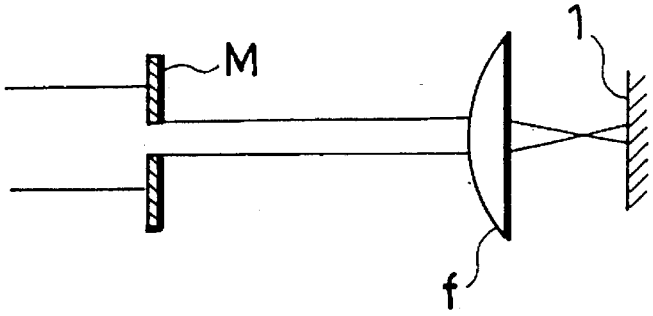
FIG. 6 is a view depicting a mask imaging method for forming pores in synthesized resin film.
Figure 7A:
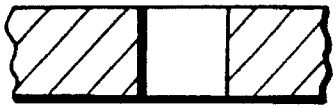
FIG. 7 is a view showing configurations of pores.
Figure 7B:
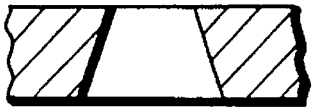
Figure 7C:
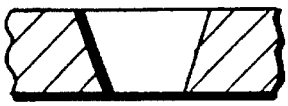
Figure 7D:
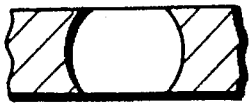
Figure 7E:
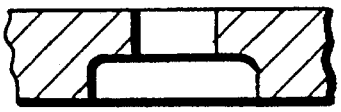
Figure 7F:
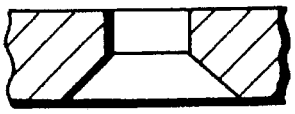

The resins with heat conductivity of 2–10 cal/sec.cm.°C. are the primary choice in terms of preventing the cross talk, in which the stainless plates are inferior to the resins. However, it can be improved by coating them with resins, and above all, they maintain excellent durability, which can be further improved by producing them with metallic powders and a resin binder. A good example is a porous ceramics film of aluminum oxide powders bounded with the binder resin, that obviates the charge injecting electrode 3 when a conductive layer is formed thereon by a vapor deposition. As shown in FIG. 6, the pores are formed by a so-called mask imaging method using an excimer laser such as LPX205iCC Model by Lambda Physics Co., Ltd.; a laser beam is closed down by a mask M, thence converged by a convex lens f in order to form an image under the conditions of a wave length of 248 nm and pulse energy of 1.5J/cm$^3$ for 10 Hz;100 pulse/25 μm.

If seen from the above, the pores may be circles, squares, triangles, ellipses, hexagons, polygons and even a combination of the foregoing configurations. Conceivable combinations are: different configurations in same size, same configurations in different size, and different in configurations and size. If seen in profile, the pores may be, as is shown in FIGS. 7(*a*) through 7(*f*), cylinders, truncated cones with the stems downward, truncated cones with the stems upward, drums, step-cylinders, and chamfer cylinders respectively. These pores may be fit into squares or staggers, and into a honeycomb if they are hexagons.

Figure 8A:
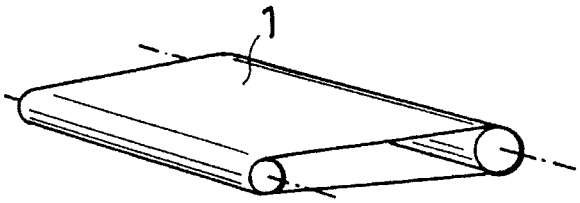
FIG. 8 is a schematic view of the entire ink carrier.
Figure 8B:
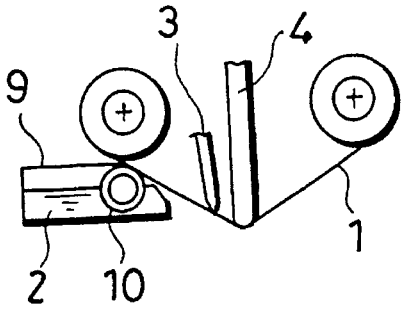

The ink carrier 1 may be an endless band as is shown in FIG. 8(*a*), or a band wrapped around reels as shown in FIG. 8(*b*), and it can be used repeatedly provided that the ink 2 is steadily replenished as it is used. For this purpose, the ink carrier 1 is designed so that the ink 2 is replenished by soaking it entirely with the ink 2 in an ink tank 9 or by maintaining contact with a roller or an ink pad 10 soaked in the ink tank 9 while it circulates or is being reeled up.

INK 2

The ink 2 is oil series pigment dispersion ink: dispersion media dispersed with pigments and dispersing agents, and it may include adducts such as masking agents and perfumes, or anti-spreading agents. Water in the air may be absorbed therein; however its influence on the properties is negligible.

The ink 2 is produced, as is done with an ink of a marker pen, by dispersing pigments, dispersing agents, dispersing media, adducts, anti-spreading agents or the like by a dispenser, followed by kneading by a distributor, and re-dispersion after other ingredients are added thereto according to the necessity. Large particles contained in the ink may be removed by filtering, or defoaming in vacuum at the finishing or any arbitrary step. The dispersing process, preferably under clean and dry ambience, takes for 10 minutes to 60 hours depending on the ingredients.

A roll mill or a ball mill is popular as the distributor; however, the following equipments are also available: paint conditioner by Red Devil Corp., a circulating supersonic wave homogenizer by Nihon Seiki Co., Ltd., a sand mill—1/8GL SAND GRINDER HILL—by Igarashi Kikai Seizo Co., Ltd., an atlighter by Mitsui Mitsuike Kogyo Co., Ltd., and a supersonic wave distributer—U0300FB—S TYPE, UT—20 —by Shinmeidai Kogyo K.K. As for the dispenser, T.K. auto homo mixer by Tokushyu Kika, Kogyo K.K is available. In particular, the roll mill is suitable when a highly solid is kneaded, and the resulting product may be diluted through a dispersion with solvent using any of these equipments by a master-batch method.

Desirable properties for the ink 2 are viscosity of 4–200 cp at a room temperature, and of 1–30 cp at 50°–170° C., at the heating temperature; electric resistance of $10^3$–$10^{10}$ Ω.cm at the room temperature, and $10^3$–$10^9$ Ωcm at the heating temperature; and surface tension of 25–55 dyne/cm at the room temperature and 15–40 dyne/cm at the heating temperature.

The thermal properties of the ink are shown in FIG. 9. It can be learned therefrom that preferable specific heat and heat conductivity are 0.1–0.9 cal/g°C. and 1.5–100 cal/sec. cm.°C., and more preferably 0.2–0.7 cal/g°C. and 2.0–70 cal/sec.cm.°C. Respectively when concerning the cross talk and multi-tone recording. These thermal properties are of no importance for the bubble-jet type recorder as was explained previously.

The ink 2, in principle, includes ingredients with relatively high boiling points; however, it may include the ones with lower boiling points may be used as well, provided that their being boiled does not affect the mechanism of the present invention.

DISPERSING MEDIA

The dispersing media is organic solvent of which boiling point is higher than 150° C., and preferably 180° C. It is at least the one selected from alcohol series solvent such as aliphatic lower alcohol having four and less carbons; complex ring compounds; glycol ether series solvent such as ethylene glycol monoalkyl ether, diethylene glycol monoalkyl ether, triethylene glycol monoalkyl ether, propylene glycol monoalkyl ether, dipropylene glycol monoalkyl ether, and tripropylene glycol monoalkyl ether; ester series organic solvent; and alkyl cellosolve, list of which follows.

Alcohol series solvent: aliphatic lower alcohol having four and less carbons such as methanol, ethanol, n-propyl alcohol(1-propanol), isopropyl alcohol(isopropanol or 2-propanol), n-butyl alcohol(1-butanol), isobutyl alcohol(2-methyl-1 -propanol), sec-butyl alcohol(2-butanol or methyl ethyl carbinol), tert-butyl alcohol(2-methyl-2-propanol or trimethyl carbinol); n-amyl alcohol; isoamyl alcohol; sec-amyl alcohol; n-hexanol; ethylene glycol; diethylene glycol; trietylene glycol; propylene glycol, dipropylene glycol; tripropylene glycol.

Ethyl glycol monoalkyl ether: ethylene glycol monomethyl ether, ethylene glycol monoethyl ether, ethylene glycol monopropyl ether, ethylene glycol monoisopropyl ether, ethylene glycol monobutyl ether, ethylene glycol monoisopropyl ether, ethylene glycol monoisobutyl ether, ethylene glycol monohexyl ether, ethylene glycol monophenyl ether.

Diethylene glycol monoalkyl ether: diethylene glycol monomethyl ether, diethylene glycol monoethyl ether, diethylene glycol monopropyl ether, diethylene glycol monoisopropyl ether, diethylene glycol monobutyl ether, diethylene glycol monoisobutyl ether, diethylene glycol monohexyl ether, diethylene glycol monophenyl ether.

Triethylene glycol monoalkyl ether: triethylene glycol monomethyl ether, triethylene glycol monoethyl ether, triethylene glycol monopropyl ether, triethylene glycol monoisoporpyl ether, triethylene glycol monobutyl ether, trietylene glycol monoisobutyl ether, triethylene glycol monohexyl ether, triethylene glycol monophenyl ether.

Propylene glycol monoalkyl ether: propylene glycol monomethyl ether, propylene glycol monoethyl ether, propylene glycol monopropyl ether, propylene glycol monoisopropyl ether, propylene glycol monobutyl ether, propylene glycol monoisobutyl ether, propylene glycol monohexyl ether, propylene glycol monophenyl ether.

Dipropylene glycol monoalkyl ether: dipropylene glycol monomethyl ether, dipropylene glycol monoethyl ether, dipropylene glycol monopropyl ether, dipropylene glycol monoisopropyl ether, dipropylene glycol monobutyl ether, dipropylene glycol monoisobutyl ether, dipropylene glycol monohexyl ether, dipropylene glycol monophenyl ether.

Tripropylene glycol monoalkyl ether: tripropylene glycol meonomethyl ether, tripropylene glycol monoethyl ether, tripropylene glycol monopropyl ether, tripropylene glycol monoisopropyl ether, tripropylene glycol monobutyl ether, tripropylene glycol monoisobutyl ether, tripropylene glycol monohexyl ether, tripropylene glycol monophenyl ether.

Ester series solvents: dimethyl adipate, 2-diethyl hexyl adipate, dibutyl adipate, diisobutyl adipate, diisodecyl adipate, dibutyl glycol adipate, 2-diethyl hexyl acetate, dibutyl sebacate, 2-di-ethyl hexyl sebacate, methyl acetyl ricinolate, diethyl maleate, dibutyl maleate, 2-diethyl hexyl maleate, dibutyl fumarate, 2-diethyl hexyl fumarate, trimethyl phosphate, triethyl phosphate, tributyl phosphate, 2-triethyl hexyl phosphate, tributoxy ethyl phosphate.

Alkyl cellosolve: methyl cellosolve, ethyl cellosolve, isopropyl cellosolve, butyl cellosolve.

Apart from the above mentioned, a mixture of ethanol and isopropanol in the weight ratio of 7:3, and methyl isobutyl keton and butyl acetate keton of 1:1 are also available. In addition, the dispersing media may include a small amount of acetates of ethylene glycol monoalkyl ether, propylene glycol monoalkyl ether, diethylene glycol monomethyl ether, diethylene glycol monoethyl ether, dipropylene glycol monomethyl ether, dipropylene glycol monoethyl ether.

PIGMENTS

Pigments for any color, for example, black, yellow, orange, red, violet, blue, green, and brown, are available. In Color Index Code, they are:

Yellow pigments 24, 86, 93, 94, 08, 109, 110, 117, 125, 137, 138, 147, 153, 154, 166, 168;

Orange pigments 36, 43, 51, 55, 59, 61;

Red pigments 97, 122, 123, 149, 168, 177, 178, 180, 187, 190, 192, 209, 215, 216 or 217, 220, 223, 224, 226, 227, 228, 240;

Violet pigments 19, 23, 29, 37, 40, 50;

Blue pigments 15, 15:1, 15:3, 15:4, 15:6, 22, 60, 64;

Green pigments 7, 36;

Brown pigments 23, 25, 26; and

Black pigment 7.

The most popular black pigments are black processed pigments of carbon black, and pigment black done with surface treatment. Available as carbon blacks are channel blacks with the diameter of a primary particle and volatility of 100 μm and 21.0%, or 200 μm and 15.0%, 35 μm and 6.0%, and 40 μm and 0.7%, and furnace black with those of 18 μm and 3.0%, and black processed pigments. Pigment black 7 done with surface treatment with styrene-maleic acid copolymer, pigment black 7 done with surface treatment with cellulose derivatives, and pigment black 7 done with surface treatment with vinyl chloride-vinyl acetate copolymer are available for black processed pigments.

For blue pigments, blue processed pigments of pigment blue 1 and 15 done with surface treatment with styrene-maleic acid copolymer, and vat blue done with surface treatment with vinyl chloride-vinyl acetate copolymer are favored.

Suitable for red pigments are red processed pigments of pigment red 15 and 220 done with surface treatment with vinyl chloride-vinyl acetate copolymer.

DISPERSING AGENTS

Natural or synthesized resins or surfactants are used as dispersing agents. Generally, 0.5–30 percent, and preferably 1–10 percent resins by weight is added to the ink 2 in order to enhance the effects of dispersion and adhesion of the pigments. These resins are selected from vinyl series resins such as polymethacrylate resin, polyacrylate resin, acrylate ester-acrylate copolymer resin, polyvinyl pyrrolidone, and polyvinyl butyral resin; hydrocarbon resin; phenol resin; xylene resin; keton resin; alkyd resin; polyamide resin; polyester resin; maleic resin; cellulosic resin; rosin resin; gelating; gasein; and shellac.

Surfactant contained in the ink is generally less than 20 percent, preferably 15 percent by weight. Applicable as the surfactants are: nonionic surfactants such as polyoxyethylene alkyl ether, polyoxyalkyl phenyl ether, polyoxyethylene fatty acid ester, and polyoxyethylene-polyoxypropylene block copolymer; anionic surfactants such as glycol ether ester, higher alcohol sulfate ester, polyoxyethylene alkyl phenyl ether ammonium sulfate(HITENOL No. 8: Dai-ichi Kogyo Seiyaku Co., Ltd.), sulfate ester of polyoxyethylene adduct, alkyl sulfate of fatty acid alkylamide, and phosphate ester of polyoxyethylene alkyl ether(ADECACOL E: Asahi Denka Kogyo K.K.); and cationic surfactants such as higher alkyl ammonium halide.

CHARGE INJECTING ELECTRODE 3

The charge injecting electrode 3 is made of a conductive plate connected to the positive electrode of a direct current power source, and also serves as a cleaner to press residual ink out of the porous ink carrier. When volume resistivity of the ink 2 is larger than $10^{10}$ Ω.cm, it is preferable to approximate it to the thermal pixels 5 concerning the recording speed.

Figure 10:
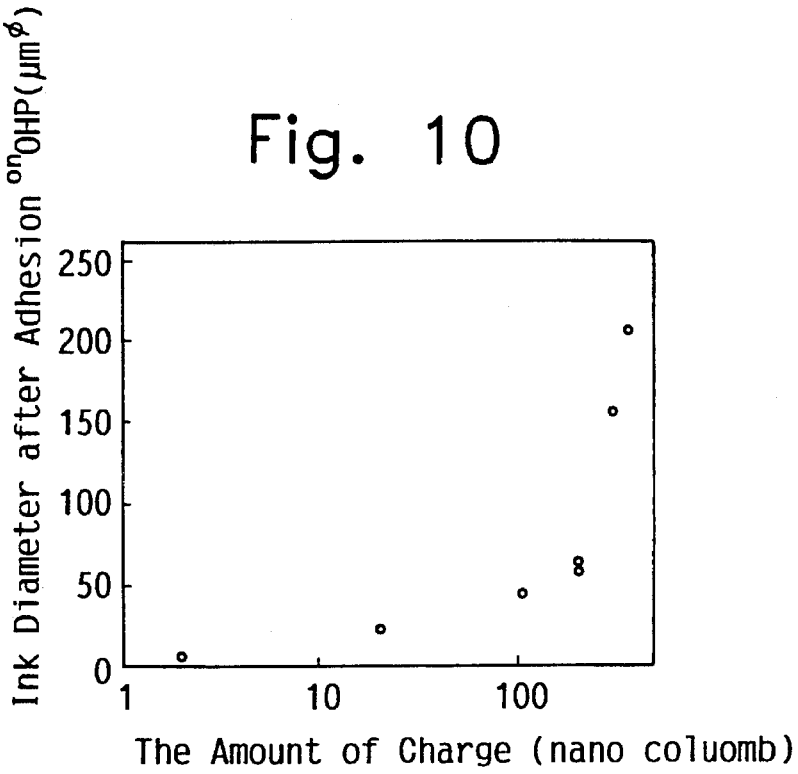
FIG. 10 is a graph showing the correlation between the amount of the charge and the diameter of the ink particle.
Figure 11A:
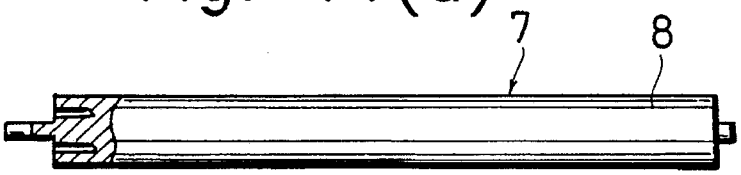
FIG. 11 is a view depicting an attracting electrode used as a bias platen roller.
Figure 11B:
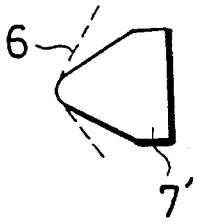
Figure 11C:
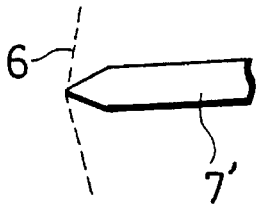
Figure 11D:
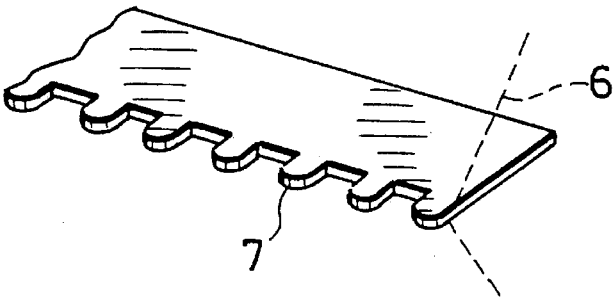
Figure 11E:
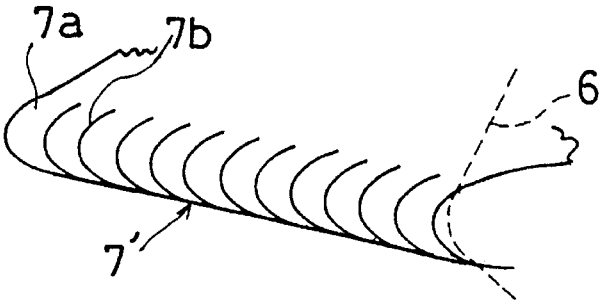

FIG. 10 is a graph of a correlation between the amount of the charges supplied to the ink 2 from the charge injecting electrode 3 and a dot diameter of the ink 2 on the recording sheet 6. Given the fact that a necessary and minimum dot diameter is 10 μm when concerning recording density, it is understood from FIG. 10 that at least a charge of 5 nq/dot is necessary, although it may slightly vary in accordance with the density of the ink 2.

The maximum charge, on the other hand, is determined by a voltage applied to the thermal head 4 within its dielectric strength, or up to its voltage ceiling, and running electricity required by it. Assuming that the maximum voltage is 1.5 kV, the maximum charge is calculated as to be approximately 1 μC/dot (0.9962μq/dot). If it operates under the conditions of 300 dpi(12 dot/mm) in solid black at 12 sheets/min, the running electricity exceeds 1 kW as the thermal head 4 conventionally requires a several hundred power[W]. Therefore, if the running electricity lower than 1 kW is desirable, the maximum charge shall be adjusted to be less than approximately 0.5 μC/dot by reducing the applied voltage.

THERMAL HEAD 4

The main assembly of the thermal head 4 is made of, for example, thermosetting fluorene series acryl resin, fluorene series melamine resin, fluorene series polyester. It is larger than the recording sheet 6 in width, and has a semicircle cylinder tip, so that it rubs against the ink carrier 1 while moving within a certain angle.

As previously mentioned, the tip is embedded with the exothermal pixels 5 aligned at regular intervals. The interval is set to be 8 dot/mm(200 dpi), 12 dot/mm (300 dpi), or 16 dot/mm (400 dpi) according to desired resolution. The surface of the tip is covered with a protecting film such as a layer of fluorene carbon polymers, commercially known as TEFLON, with a thickness of 3 μm, or a tantalum oxide($Ta_2O$) layer with a thickness of 3 μm, and a silicon dioxide($SiO_2$) layer with a thickness of 1 μm. The protecting film renders inkphobia to the tip as well as further facilitates its skidding on the ink carrier 1 by reducing friction therebetween.

The thermal head 4 may also serve as the charge injecting electrode 3 by rendering conductivity to the surface thereof, in particular, when a highly insulating ink is used. Because it must be charged by polarization, the thermal head 4 serving also as the charge injecting electrode 3, neighboring the bias platen roller 7, contributes to more efficient charging with a relatively low voltage.

Constructed in this way, the thermal head 4 maintains a recording frequency of 400 Hz, a pulse width of 500 μsec, an average temperature of 120° C., with a voltage of 24 V and electrical power of 0.2 W/dot at 25° C., and given these conditions, the ink 2 maintains an average temperature of 85° C. on the surface.

BIAS PLATEN ROLLER 7

As is shown in FIG. 11(*a*), the bias platen roller 7 is either a cylinder or a circular cylinder coated 0.05–500 μm in thickness with the insulator 8 such as thermoplastic resins, thermosetting resins, photosetting resins, photoconducitive resins or the like, list of which follows.

Thermoplastic resins: polyester resin, polyamide resin, polybutadiene, acryl resin, ethylene-vinyl acetate copolymer, ion exchange olefin copolymer(ionomer), styrene-butadiene block copolymer, polycarbonate, vinyl chloride-vinyl acetate copolymer, cellulose ester, polyimide;

Thermosetting resins: epoxy resin, urethane resin, silicone resin, phenol resin, melamine resin, xylene resin, alkide resin; and Photosetting resins: poly-N-vinyl carbazole, polyvinylpylene, polyvinyl anthracene.

Amongst of all, silicone resin, acryl resin, melamine resin, polycarbonate, polybutadiene, and epoxy resin with a volume resistivity larger than $1\times10_{14}$ Ω.cm are desirable.

Although, the bias platen roller 7 is preferable in terms of sheet forwarding, it may be replaced with an attracting electrode 7'. In this case, triangular edge with a round tip or a simple triangular edge as shown respectively in FIGS. 11(*b*) and 11(*c*) are preferable in order to ensure its contact to the recording sheet 6. Given the fact that more the contact is ensured, more the resolution is improved, eliminating the problem of imperfect dots, it is more preferable that these edges are designed so that they rub against the recording sheet 6 within a certain angle. As well, the edge may be teeth formed at the same or narrower intervals than those of the exothermic pixels 5 as shown in FIG. 11(*d*).

Likewise, as shown in FIG. 11(*e*), the attracting electrode 7'may be composed of a polyimide film 7*a*, one end of which is smoothly rounded and stirps 7*b* of copper or aluminum attached thereto at the same or narrower intervals than those of the exothermic pixels 5. With such roundness further ensuring the contact to the recording sheet 6, a voltage can be applied only to the strips 7*b* which have been selected based on the image data.

As is explained in the above, the jet-type recorder of the first embodiment records the image by heating the ink 2 at a relatively low temperature so that the surface tension and viscosity of the ink 2 decrease, which not only eliminates the problems of burns and discoloration of the ink, or damages on the thermal head 4, but also reduces the running electricity.

Furthermore, in addition to the intrinsic advantages of pigments such as superiority in the recording density and anti-spreading compared with the dyes, oil series pigments used herein increase a fixing speed as well as enhance photophobia and hydrophobia.

In addition, since the nozzles are no longer essential components herein, the recorder of this embodiment is free of maintenance for nozzle clogging.

In this embodiment, the electrical energy is uniformly applied to the ink 2 while the thermal energy is applied to only where it is necessary. However, other methods are also available: the thermal energy is uniformly applied to the ink 2 while electrical energy is applied only to where necessary in an opposing electrode; both the electrical energy and thermal energy are applied to only where necessary. More precisely, the former employs the attracting electrode 7' as shown in FIG. 11(*e*) to apply a negative voltage only where necessary, and the latter employs a combination of the thermal head 4 and attracting electrode 7' as shown in FIG. 11(*e*).

Also, an alternating current voltage, a non-uniform alternating current voltage, or a direct current pulse besides the direct current voltage can be applied to the charge injecting electrode 3 and bias platen roller 7. It can be said that applying the alternating voltage is more effective in terms of upgrading resolution, because the resulting vibration helps to sever the ink 2 from the ink carrier 1.

SECOND EMBODIMENT

The ink-jet type recorder in accordance with the second embodiment is designed so that it records a multi-color image, and it has the same construction of the first embodiment, except that it employs the ink carrier 1 for multi-color recording. In addition, the recording sheet 6 circulates or makes round trips for the multi-color recording, and a positive voltage of 300 V is applied to the charge injecting electrode 3, while a negative voltage of 1 kV is applied to the bias platen roller 7. Hereinafter, like components are labeled with like reference numerals with respect to the first embodiment, and the description of these component is not repeated.

Figure 12:
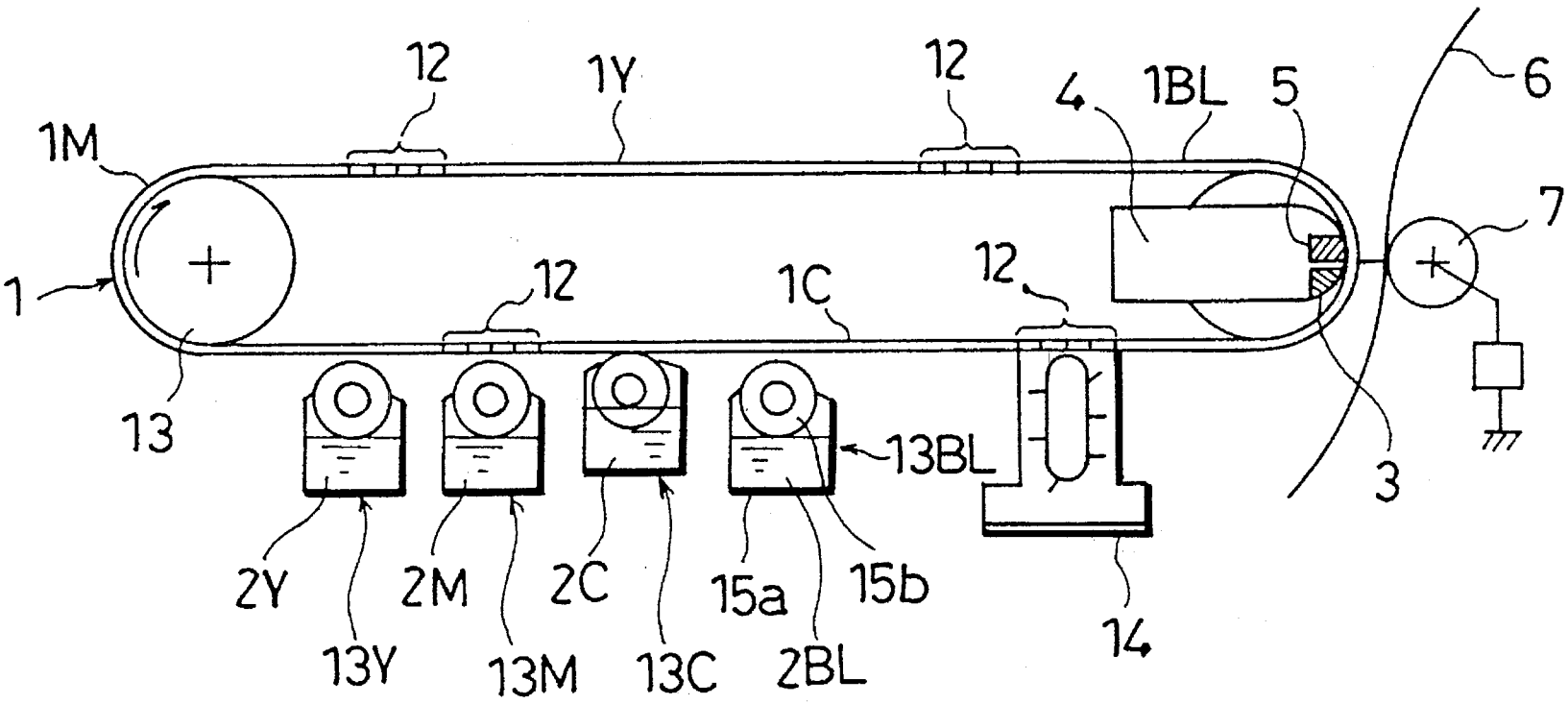
FIG. 12 is an illustration of a color printer in accordance with the second embodiment of the present invention.

FIG. 12 is a view depicting the construction of a color printer exploiting the method explained in the first embodiment; the ink carrier 1 in the form of the endless belt circulates around an axis 13 driven by a motor and the opposing thermal head 4.

The ink carrier 1 made of meshes is divided into four ink carrying sections 1BL, 1C, 1M, and 1Y as well as four head cleaners 12. Each ink carrying section 1BL, 1C, 1M, and 1Y carries respective ink colors, and is adjacent to one of the cleaners 12 so that the inks will not mixed up. The cleaners 12 clean the thermal head 4 in order to prevent residual ink of any color thereon from adhering to the other ink carrying sections. Each carrying section is the same as the recording sheet 6 in full length. The ink carrier 1, of course, can be divided into any arbitrary numbers depending on the number of desired colors. Underneath of the ink carrier 1, a cleaner 14 for cleaning the head cleaners 12, a black ink pad 13BL, a cyan ink pad 13C, a magenta ink pad 13M, and a yellow ink pad 13Y for respective ink carrying sections are aligned downstream. Each ink pad is composed of an case 15*a* containing a window as wide as the ink carrying sections and a spreading roller 15*b* moving upward/downward in the case 15*a*.

Associated with the clockwise circulation of the ink carrier 1, the black ink pad 13BL, cyan ink pad 13*c*, magenta ink 13M, and yellow pad 13Y move upward when the respective ink carrying sections 1BL, 1C, 1M, and 1Y approach so that they spread the respective ink 2BL, 2C, 2M, and 2Y by way of contact, thence moves downward so as to release the contact thereto. During the contact, each of the spreading rollers 15*b* presses against the respective ink carrying sections as it rotates, so that it spreads the ink on the surface thereof. After the ink spreading, the ink case 15*a* moves downward, hence the spreading roller 15*b* loses its contact to the ink, and closes the window in order to prevent uneven spreading, ink running through a capillary phenomenon, or ink decomposition thorough evaporation.

Likewise, the cleaner 14 moves upward when any of the head cleaners 12 approach so as to rub against it as it passes by, thence moves downward so as to release the contact thereto until the next head cleaner 12 approaches.

THIRD EMBODIMENT

The third embodiment explains how the ink 2 is replenished when the ink carrier 1 neither rotates nor being reeled up. It has the same construction of the first embodiment except that a part of the ink carrier 1 is fixedly soaked with an ink tank 9. Hereinafter, like components are labeled with like reference numerals with respect to the first embodiment, and the description of these component is not repeated.

The ink carrier 1 is made of a porous ceramics film of 70 μm in thickness. It is produced by bonding aluminum oxide powders with the binder resin, and by attaching an unillustrated conductive layer serving also as the charge injecting electrode 3 thereto by vapor deposition, through which the conductive layer is transmuted into a porous one. The layer may be attached on the bias platen roller 7 or thermal head 4 so as to face the ink carrier 1.

Figure 13:
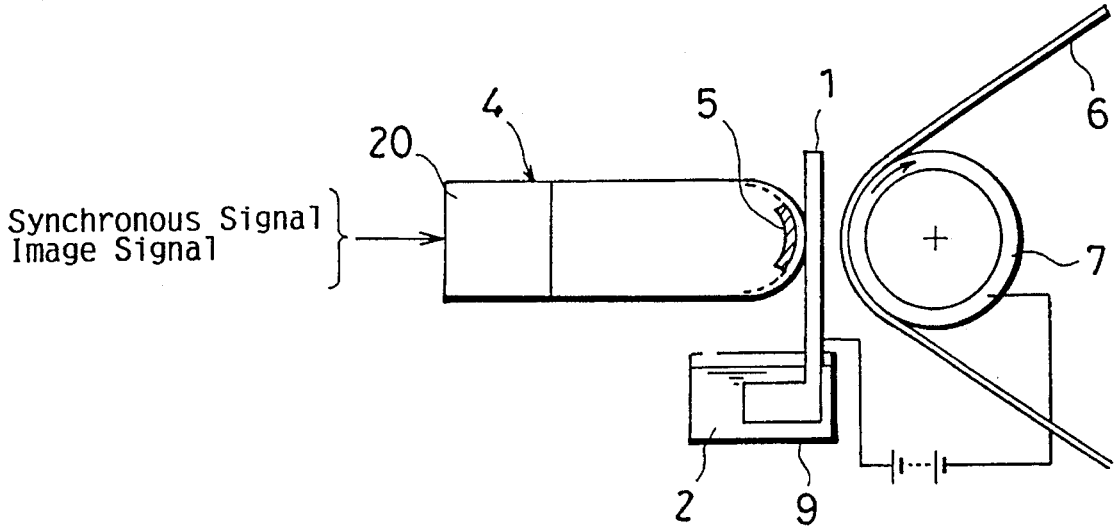
FIG. 13 is a view of another recorder in accordance with the third embodiment of the present invention.

A circuits 20 drives each exothermic pixel 5 in accordance with a synchronous signal and an image signal in order to form the image by means of ink spouting, and the ink 2 is replenished steadily where it is used by the capillary phenomenon; thus, a part of the ink carrier 1 is soaked with the ink 2 in the ink tank 9 as shown in FIG. 13.

When the ink carrier 1 is made of mesh, the ink 2 is replenished by the capillary phenomenon as well. However, because a combination of the mesh ink carrier 1 and high viscous ink 2 decreases a replenishing speed, it is more efficient to replenish the ink 2 directly to where it is used as was explained in the first embodiment, and such is the case with the ink carrier 1 made of synthetic resin films, in which no capillary phenomenon occurs.

In this type of recorders, several ink carriers 1, if used separately, enable the multi-color recording.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An ink-jet recorder which forms an ink image on a recording medium, comprising:

a porous ink carrier which has a plurality of pores;

an ink tank which holds ink, said porous ink carrier being soaked with said ink held in said ink tank at a soaking position, so that ink is withheld in said pores of said porous ink carrier;

a transferring mechanism which transfer said porous ink carrier from said soaking position to a recording position where the porous ink carrier faces the recording medium;

a contact heater which is in contact with said porous ink carrier at the recording position so as to heat the withheld ink to a certain temperature, the certain temperature being sufficiently high to lower a viscosity of the ink but insufficiently high to boil the ink;

a feeding mechanism which feeds the recording medium to the recording position;

a first electrode which is in contact with said porous ink carrier at a contact position which is between said soaking position and said recording position, said first electrode regulating a quantity of ink withheld in said pores;

a second electrode which opposes the contact heater with said recording medium in between said second electrode and said contact heater; and an electric power source which is connected with said first electrode and said second electrode for generating an electric field between said first electrode and said second electrode so that the heated ink spouts out toward the recording medium.

2. An ink-jet recorder of claim 1, wherein said contact heater is divided into a plurality of sections orthogonal to a direction in which said porous ink carrier is transferred by said transferring mechanism.

3. An ink-jet recorder of claim 1, further comprising:

a controller which controls a heating temperature of the contact heater in accordance with tone data in an image signal.

4. An ink-jet recorder of claim 1, wherein said porous ink carrier comprises an endless belt.

5. An ink-jet recorder of claim 1, wherein said porous ink carrier comprises a band wrapped around a plurality of reels.

6. An ink-jet recorder of claim 1, wherein said porous ink carrier is made of a mesh knitted material.

7. An ink-jet recorder of claim 6, wherein said mesh knitted material has a thread diameter of 20–150 μm and apertures of 5–200 μm.

8. An ink-jet recorder which forms an ink image on a recording medium comprising:

an ink tank which holds ink;

a porous ink carrier which is fixedly provided and soaked with said ink held in said ink tank at a soaking position so that ink is withheld in said porous ink carrier, said porous ink carrier extending from said soaking position to a recording position where said porous ink carrier faces said recording medium;

a contact heater which contacts said porous ink carrier at said recording position for heating the withheld ink to a certain temperature, the certain temperature being sufficiently high to lower a viscosity of the ink but insufficiently high to boil the ink; and means for generating an electric field so that the heated ink withheld in said porous ink carrier spouts out toward the recording medium.

9. An ink-jet recorder of claim 8, wherein said porous ink carrier comprises a porous ceramics film.

* * * * *

UNITED STATES PATENT AND TRADEMARK OFFICE

CERTIFICATE OF CORRECTION

PATENT NO. : 5,546,108

DATED : August 13, 1996

INVENTOR(S) : Hideo Hotomi, et al.

It is certified that error appears in the above-identified patent and that said Letters Patent is hereby corrected as shown below:

On the title page, in item [54] line 2 of the title change "LETTING" to --JETTING--.

In Col. 1, line 2, change "LETTING" to --JETTING--.

In Col. 1, line 42, change "Speed" to --speed--.

In Col. 5, line 5, before "paint" insert --a--.

In Col. 5, line 12, change "T.K. auto homo mixer" to --T.K. AUTO HOMO MIXER--.

In Col. 11, line 25, (Claim 1, line 8), change "transfer" to --transfers--.

Signed and Sealed this

Fifth Day of November, 1996

*Attest:*

*Attesting Officer*

BRUCE LEHMAN

*Commissioner of Patents and Trademarks*

UNITED STATES PATENT AND TRADEMARK OFFICE

CERTIFICATE OF CORRECTION

PATENT NO. : 5,546,108

DATED : August 13, 1996

INVENTOR(S) : Hideo Hotomi et al

It is certified that error appears in the above-indentified patent and that said Letters Patent is hereby corrected as shown below:

Title page, Item [54], line 1 of the title, delete "TYPE".

Title page, Item [54], line 3 of the title, delete "ELETROSTATIC" and insert --ELECTROSTATIC--.

Column 1, line 1, delete "TYPE".

Column 1, line 3, delete "ELETROSTATIC" and insert --ELECTROSTATIC--.

Signed and Sealed this

Eighteenth Day of March, 1997

Bruce Lehman

*Attest:*

BRUCE LEHMAN

*Attesting Officer*

*Commissioner of Patents and Trademarks*